US005114059A

United States Patent [19]

Thatcher

[11] Patent Number: 5,114,059

[45] Date of Patent: May 19, 1992

[54] UNIVERSALLY ADJUSTABLE, FRAMELESS BACKPACK

[75] Inventor: G. Bryce Thatcher, Rexburg, Id.

[73] Assignee: Ultimate Direction, Inc., Rexburg, Id.

[21] Appl. No.: 620,018

[22] Filed: Nov. 30, 1990

[51] Int. Cl.[5] ..... A45F 3/04

[52] U.S. Cl. ..... 224/209; 224/216

[58] Field of Search ..... 224/208, 209, 215, 216, 224/259, 907, 211

[56] References Cited

U.S. PATENT DOCUMENTS

| | | | |
|---|---|---|---|
| 840,332 | 1/1907 | Howard et al. | 224/216 |
| 4,676,418 | 6/1987 | Lowe | 224/215 |
| 5,025,965 | 6/1991 | Smith | 224/215 |

FOREIGN PATENT DOCUMENTS

| | | | |
|---|---|---|---|
| 174134 | 8/1905 | Fed. Rep. of Germany | 224/215 |
| 357161 | 8/1922 | Fed. Rep. of Germany | 224/209 |
| 227316 | 1/1925 | United Kingdom | 224/215 |

*Primary Examiner*—Henry J. Recla
*Assistant Examiner*—Robert M. Fetsuga
*Attorney, Agent, or Firm*—Robert A. de Groot

[57] ABSTRACT

A universally adjustable frameless backpack is provided for use by the more active sportsperson. The pack has a pivoted shoulder harness that allows the pack to remain relatively stationary while the person's body and shoulders swing back and forth as in jogging, running, or cross-country skiing. The hip pad also has a novel attachment to the pack that allows hip motion without excessive swinging of the pack causing unbalance of the runner or jogger.

31 Claims, 3 Drawing Sheets

UNIVERSALLY ADJUSTABLE, FRAMELESS BACKPACK

FIELD OF THE INVENTION

This invention relates to a universally adjustable, frameless backpack for backpackers that can also be used by energetic runners, bikers, skiers, and joggers, providing comfort to the wearer and adaptability to vigorous body motion.

BACKGROUND OF THE INVENTION

The sport of backpacking has achieved an amazing growth in popularity in recent years. This has, in turn, produced a great increase in production of backpacks for hikers. It has also stimulated the development of many improvements in designs of pack assemblies for carrying clothes, food, equipment, and water.

There are four basic types of packs including: a frame pack having a shoulder harness and a hip belt for larger capacities (i.e., 3000 cubic inches and up); a frameless pack, having a shoulder harness and hip belt; a day pack having a shoulder harness; and, for a minimum load, a hip belt pack. Frameless packs are used for medium capacity loads (i.e., 1500–3000 cubic inches) and are desirable because of their lighter weight (i.e., 2–3 pounds), as compared with the frame packs which typically are 4–6 pounds.

Many improved designs have been based on the recent discovery that the backpack should be allowed to swing, to a restricted degree, with each stride of the load-carrying person. The hiker can carry his pack for a longer period of time, with less fatigue and greater comfort, if the pack load on his back is supported by the lumbar region and movable, within limits, so that his body does not jerk the pack through a series of forceful oscillations corresponding to the walking or running rhythm. The flexibility of the pack reduces the pounding on the hiker's back.

On the other hand, it is important that the swinging movement be not only restricted but also adjustable to the peculiar characteristics of each hiker. Every person has a slightly different body build, muscle distribution, and stride characteristic. Even the same person may prefer changing the adjustment of his pack assembly from time to time, in order to switch the load slightly from one set of muscles to another. In previously known moveable backpacks, a crude combination of restricted movement and adjustability has been achieved by simply loosening the canvas straps by which it has been customary to tie the lower end of the pack to a padded waist belt encircling the waist of the load-carrying person. Such flexible straps permit the pack frame to swing in unpredictable manners, not adequately restricted for the needs of comfort of the wearer. Also, adjustability has proven unreliable, since a canvas strap may stretch, or loosen.

Many expert backpackers prefer a pack assembly which includes connections directly to the sides of the waist belt. A person carrying such a pack feels the load on the sides of his hips, rather than as something hanging down behind him. Unfortunately, such a pack frame mounting precludes the use of the swinging feature, also desirable to most expert backpackers. It is a feature desired by many expert backpackers that the pack load be mostly carried by the waist belt.

It is another desire of active packers, such as runners, that the body of the runner be allowed to freely pivot at the shoulders and the hips while the pack and gear remain in a relatively neutral, vertical position. This pivoting motion occurs with runners' shoulders and hips, skiers' shoulders and hips, and bikers' hips.

It is, therefore, an object of this invention to provide a soft, comfortable backpack that supports the pack in the comfortable lumbar region of the back, which allows pivotal body motion at hips and shoulders and allows complete adjustability of load location and shoulder harness attachments. It is another object of this invention to provide easy access to water bottles that are contained within thermally insulated holsters.

SUMMARY OF THE INVENTION

In accordance with the present invention, a universally adjustable, frameless backpack is provided. The backpack of the present invention generally stated comprises a nylon cloth body having a plurality of compartments, including a main compartment accessible by a top zipper, two insulated side compartment bottle holsters, a triangular zipper pocket at a center portion of the pack, and, on larger models, a gussetted zipper pocket below the triangular pocket, a shoulder harness, and a hip belt.

A shoulder harness attaches pivotally to the body within a slot between a back pad and the body. It ca be adjusted up or down on a pivot buckle, thereby adapting to different body lengths. The shoulder harness also has adjustable and padded shoulder straps that can also be shortened or lengthened. The shoulder straps are maintained on the shoulders by a shoulder blade strap on the back and a sternum strap on the chest. The front portion of the straps have a diagonally fixed nylon mesh piece on each strap that has a buckle and a mesh piece strap attached to the pack body adjacent the bottle holsters at the sides.

A hip belt and attached hip pad are inserted in a slot between the body and a lumbar pad to support the bulk of the pack weight. It is attached to the body by hook-and-pile (Velcro TM ) fasteners at the back and a pair of side-support bi-directional compression straps, which each attach to the body at two points. The Velcro TM allows for removal of the belt. The pair of compression straps are attached to the belt by a loop, thereby allowing sliding engagement while maintaining constant compression as the hips rise and fall, for instance, during running or jogging. The angle of the belt on a front portion of the belt pad is also adjustable by another vertical Velcro TM attachment, thereby providing side support adjustment means.

Some of the advantages of the compartment designs include gussetted panels on the main compartment allowing for a neat pack when full or only partially loaded, and the gussetted pocket on the bottom back portion of the pack.

The diagonally oriented zipper on the holster pockets permits the backpacker to reach, unzip, and remove the water bottles from the insulated pockets while walking, without removing the pack from his back. The holster pocket top flaps also can be left open and Velcro TM hooked to the inside of the pocket, allowing quick access to the water bottle.

The triangular pocket is also a handy and convenient pocket for storage of flat objects or papers. It also provides a single attachment point for the torsolink buckle on the back of the harness, termed as the Torso Link Harness System by the inventor. As in most packs in the industry, each zipper has a zipper tab loop to aid in opening the zipper.

The unique Torsolink Harness System TM allows the body to pivot and move with agility while the pack and gear remain in a relatively neutral and vertical position, thus eliminating the horizontal swinging motion which tends to unbalance the athlete and reduce efficiency and speed of motion. This is accomplished by the single torsolink buckle attachment on the back of the pack, the free pivoting shoulder harness attachment at the pivot buckle, and the belt bi-directional compression straps, which allows hips to swivel without excess lower pack motion and the single belt Velcro TM fastener point at the lower center of the pack.

Other objects, advantages, and capabilities of the present invention will become more apparent as the description proceeds.

DETAILED DESCRIPTION OF THE INVENTION

Figure 1:
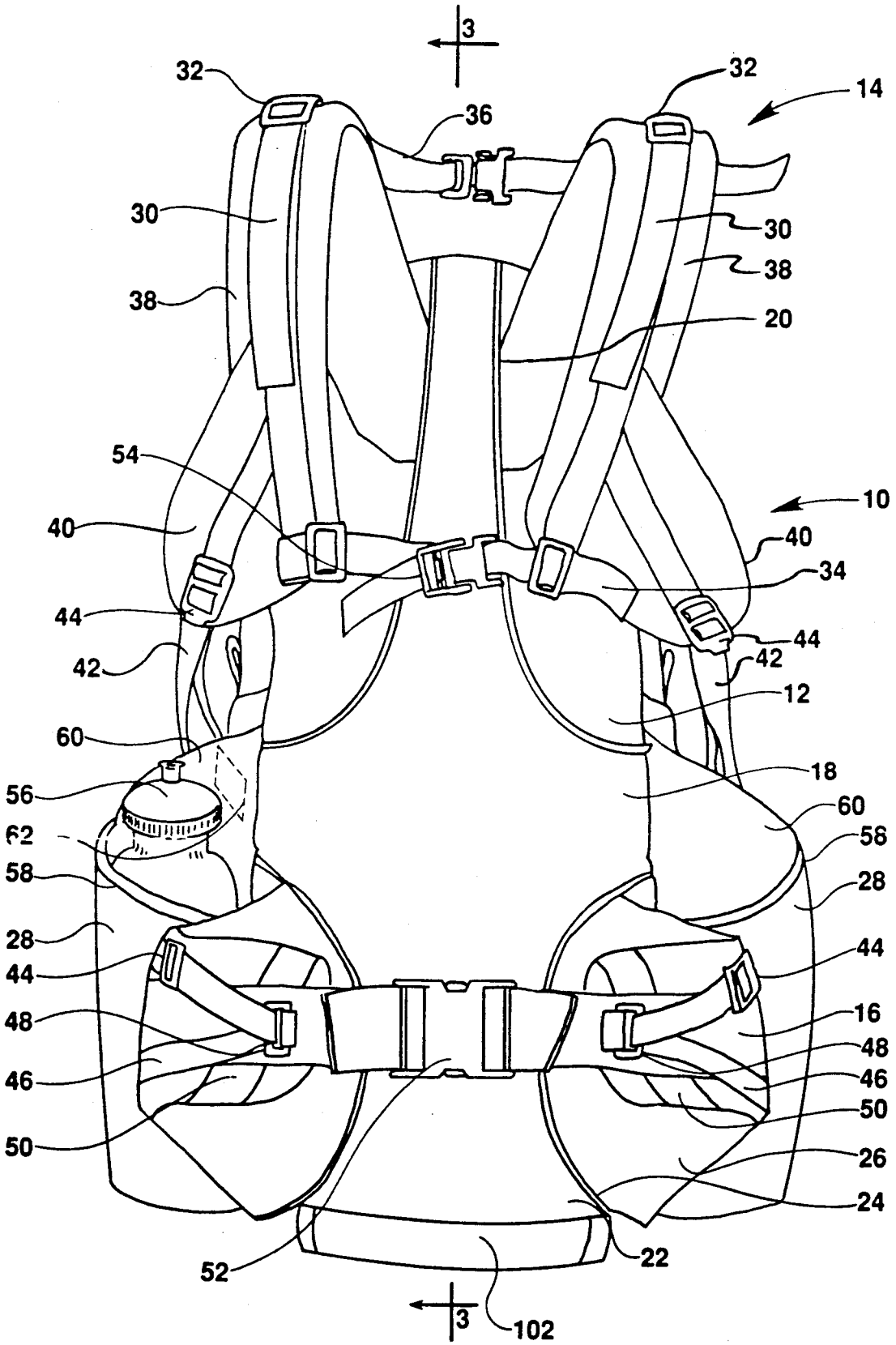
FIG. 1 is a front elevation of the backpack constructed in accordance with the present invention.
Figure 2:
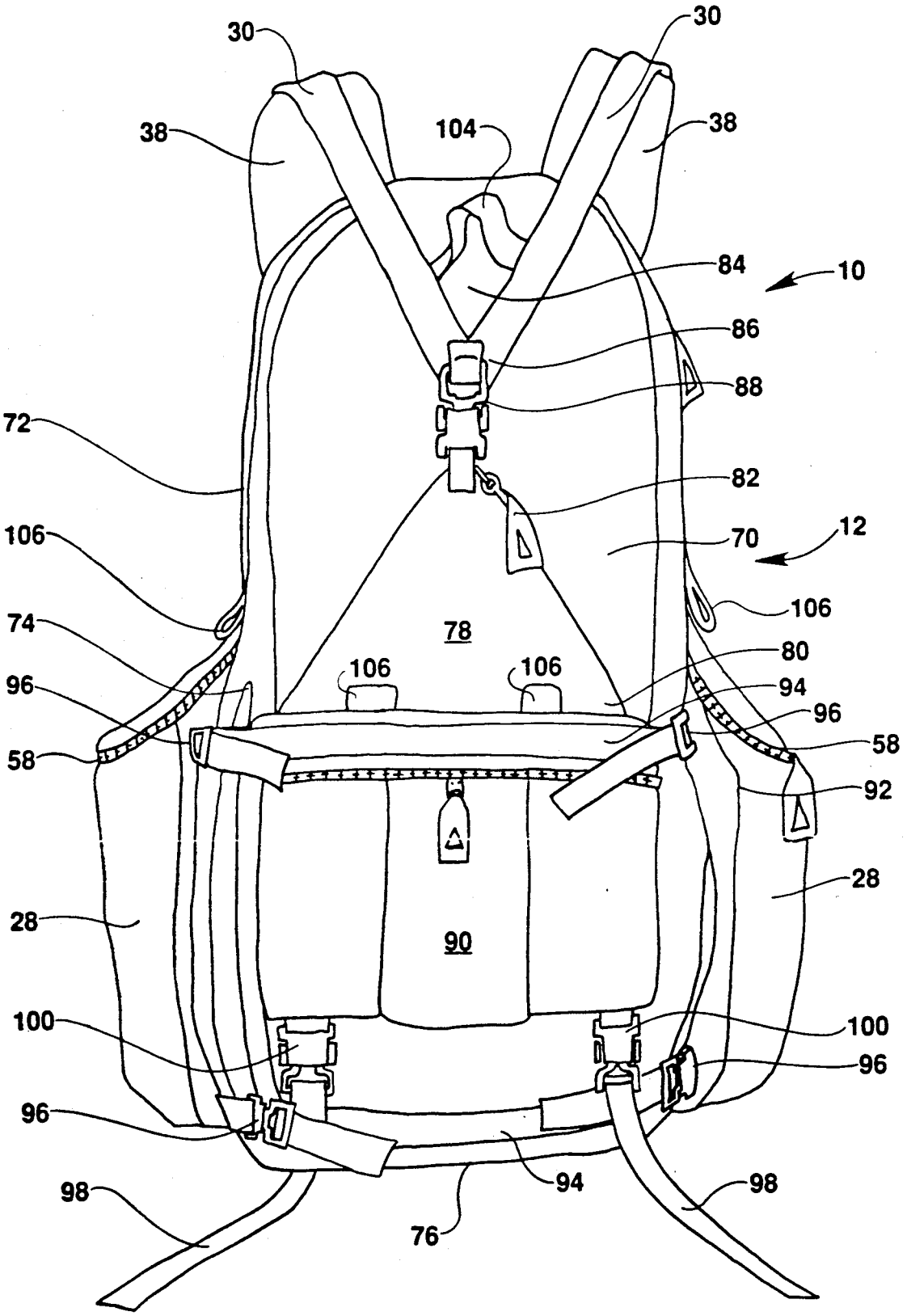
FIG. 2 is a back elevation of the invention.
Figures 3, 4:
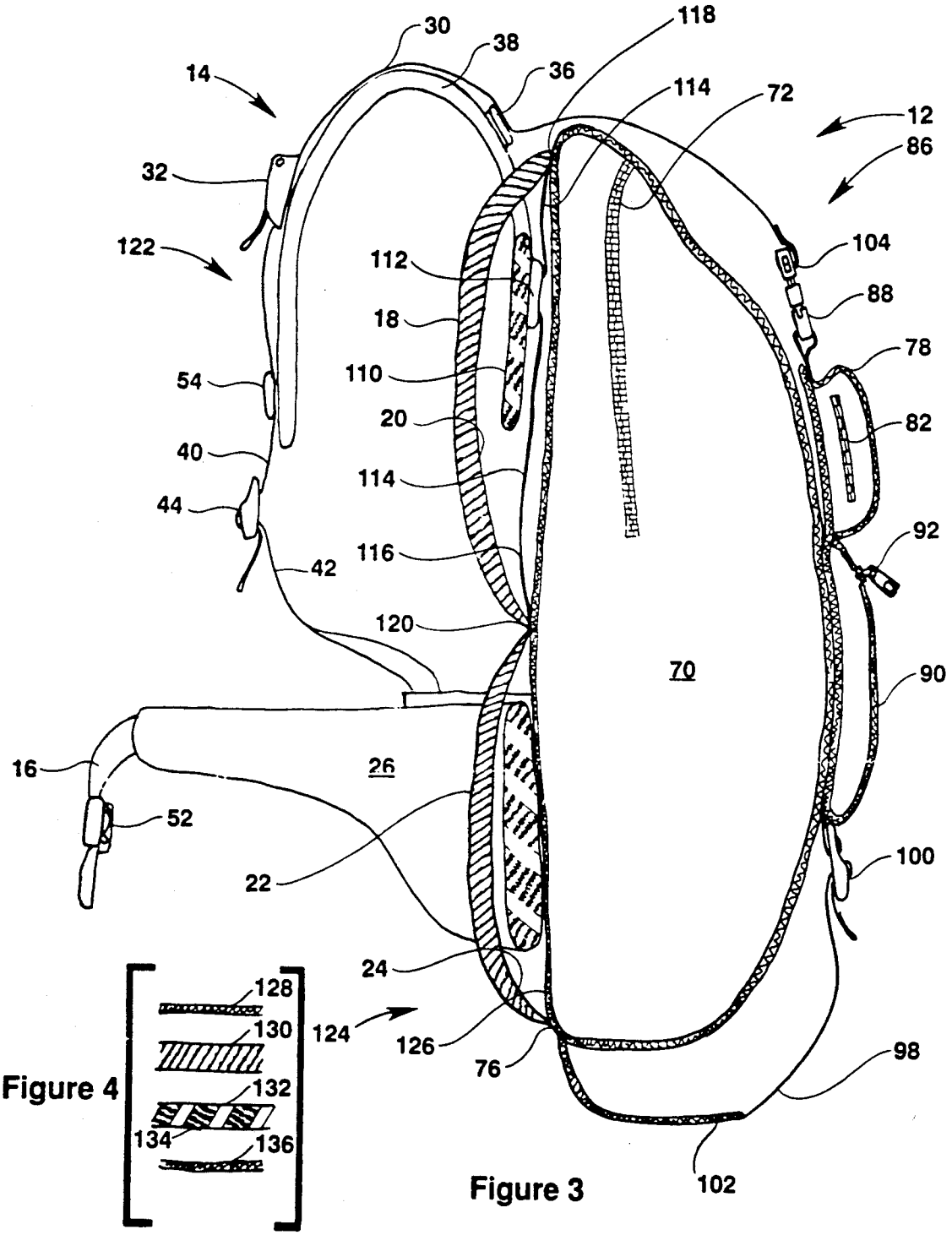
FIG. 3 is a side sectional view of the backpack taken along lines 3—3 of FIG. 1.
FIG. 4 is a cross-sectional view of a preferred embodiment of a hip pad and shoulder pad materials.

A universally adjustable, frameless backpack constructed in accordance with the invention is illustrated in FIGS. 1-3. Referring to FIG. 1, the backpack 10 generally stated includes a body 12, an adjustable shoulder harness 14, and an adjustable and detachable belt 16. An inverted T-shaped back pad 18 is attached to an upper front portion of the body providing a horizontal shoulder harness slot 20. A lumbar pad 22 is attached to a lower body portion also providing a horizontal belt slot 24. The shoulder harness 14 slips into the shoulder harness slot 20 and is pivotally fixed to the body 12. In a similar manner, the belt 16 and attached hip pad 26 are removably fixed to the body 12 within the belt slot 24. FIG. 1 illustrates two of the four or five compartments, i.e., the insulated bottle holsters 28.

The shoulder harness 14 consists of shoulder straps 30 having length-adjusting cam-lock buckles 32. The strap 30 length adjustment permits the wearer to raise or lower the pack position on his back. The harness is held on the chest by a sternum strap 34 and on the shoulders by an adjustable shoulder blade strap 36, which maintain a fixed distance between the shoulder straps 30. Both of these straps can be raised or lowered by inserting the straps within different vertical slots on the shoulder straps. Shoulder pads 38 have a breathable material encased in a nylon mesh to carry moisture away from the backpacker's body. The front portion of the straps 30 are affixed to the body 12 by a diagonal nylon mesh piece 40 and mesh piece straps 42 which attach to the body adjacent to the bottle holsters 28, and are adjustable at typical adjusting belt loop 44.

Belt 16, in addition to being affixed to the body 12 within belt slot 24 is restrained to the body by a pair of bi-directional compression straps 46. These straps pass through belt loops 48 and allow sliding of the belt 46 within the loops 48 as the motion of the wearer's hips cause the belt 16 to move up and down while running, jogging, or ski-ing. The strap length is adjustable at adjusting belt loop 44. The angle of the belt 16 on the wearer's body is also adjustable by positioning the belt up or down on hook-and-pile fastener 50, e.g. Velcro TM or the like.

The pack is removed from the wearer by disengaging the quick-release belt buckle 52 and quick-release sternum buckle 54. The water bottle 56 can be removed from holster 28 by unzipping diagonal zipper 58. Additionally, the holster top flap 60 can be held open and affixed to the inside of the holster 28 by another Velcro TM piece 62 (shown in phantom) so as to give easy and quick access to bottle 56.

Referring now to the back view of FIG. 2, the plurality of compartments can be seen. The wedge-shaped main compartment 70 is accessible by a zipper 72 which runs from one side to the other across a top portion of the pack 10. The wedge shape is constructed by the use of gussets 74 on the lower portion of pack 10. There are also gussets on the bottom 76 of the main compartment 70.

Triangular zipper pocket 78 serves to contain small, flat articles and is also a tie point between shoulder harness 14 and a center portion 80 of body 12. Access to this pocket 78 is at zipper 82.

The tie point identified as torsolink 84 is a triangular shape nylon mesh that joins the two straps 30 as at 86. A torso quick-release buckle 88 joins the torsolink to the triangular pocket 78 so as to transfer a small portion of the pack weight to the shoulders and pulls the top of the pack tight against the back.

On larger pack sizes there is an additional gussetted pocket 90 affixed to a lower back portion of the body 12, having horizontal zipper 92.

The contents of the pack are compacted by a pair of horizontal compression straps 94 which are attached by horizontal quick-release buckles 96 to the bottle holsters and compress a mid-portion 80 and bottom portion 76 of the main compartment 70. The bottom portion 76 is also compacted vertically by a pair of vertical compression straps 98 attached to the body by vertical quick-release buckles 100. The bottom end of straps 98 may be attached to the bottom body portion 76 or to a bottom flap 102 (FIG. 3) which protects the pack 10 when setting on the ground.

Some attachments typical to the pack industry include grab loop 104 and lash point loops 106.

Referring now to the cross-section view of FIG. 3, the details of the harness 14 and pivotal attachment to body 12 can be seen. Shoulder pad V-section 110 and one end of strap 30 is attached to pivot buckle 112. This buckle 112 is adjustably affixed to a vertical harness strap 114 and can be located up or down so as to raise or lower the pack on the wearer's back. A tall person would have the pad 110 and buckle as shown, whereas a short person would locate the buckle 112 at a lower position 116. The back pad 18 and the harness strap 114 attach to the body 12 at a body upper portion 118 and body middle portion 120.

The shoulder straps 30 attach to a front portion 122 of harness 14 and connect together forming a V-shaped joint 86 (FIG. 2) at the back portion of the harness which attaches to the quick-release buckle 88. Buckle 88 which is removably affixed to the triangular pocket 78. The front portion 122 of the harness connects to the body front middle portion 120 adjacent the bottle holsters by the mesh piece strap 42.

One of the novel features of the shoulder harness 14 is the permanently curved contour of the pad 38 and strap 30. This is purposely done by sewing a shorter nylon fabric piece 128 (FIG. 4) on the inside and a longer piece 136 on the outside. This curvature prevents web material 128 from bunching up on the wearer's shoulder, typical of most other shoulder harnesses.

The belt 16 and hip pad 26 attachment behind lumbar pad 22 can be seen in body lower portion 124. Attachment of belt 16 to lower body portion 124 is done by hook-and pile piece 126. The belt comes in three sizes to suit a packer's waist and hip size.

A space above flap 102 can be used for bed roll or sleeping bag stowage by adjusting vertical compression ladder lock buckle 100.

A preferred embodiment of the shoulder pad 38 and hip pad 26 is shown in cross-section FIG. 4. An inside nylon mesh 128 is adjacent the wearer's body and covers a hydrophobic foam 130 that wicks water away from the body. Adjacent the hydrophobic foam 130 is a closed cell foam pad 132 having multiple apertures 134 allowing water vapor to pass through and exit through outer nylon mesh 136. This construction is used on the larger packs to better distribute the compression load from the belt and shoulder harness to the hips and shoulders of the backpackers.

It is apparent from the foregoing that a novel and unobvious backpack has been provided having many useful features that provide for comfort nd motion efficiency of the backpacker or sportsman. The pack is universally adjustable at the many quick-release buckles, belt loops, and cam lock buckles.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

What is claimed is:

1. A universally adjustable backpack comprising:

a pack body having front, side, and back walls defining a plurality of compartments;

a back pad affixed substantially transversely across an upper portion of the back wall to form a substantially transverse shoulder harness slot;

an adjustable shoulder harness pivotally affixed to the body back wall within the shoulder harness slot;

a lumbar pad affixed substantially transversely across a lower portion of the back wall for contacting a lumbar region of a person's body and to form a substantially transverse belt slot; and an adjustable and detachable belt pivotally inserted within the belt slot between the lumbar pad and body back wall;

whereby the shoulder harness and detachable belt may pivot with respect to the body and the weight of the backpack is supported by the lumbar region of the person's body.

2. The backpack as defined in claim 1 and wherein the plurality of compartments further comprise:

a wedge-shaped main compartment zippered at a top portion of the body;

a pair of insulated bottle holsters attached on the side walls of the body; and a triangular zipper pocket attached at a center portion of the back wall of the body.

3. The backpack as defined in claim 2 and wherein a gussetted zipper pocket is attached at the lower back wall portion of the body.

4. The backpack as defined in claim 2 and wherein the bottle holsters have a diagonal zipper and an inside hook-and-pile fastener such that an open holster cover may be hooked to allow access to a water bottle within the holster.

5. The backpack as defined in claim 1 and wherein the body is gussetted at a lower side portion of the body and at a bottom portion of the body.

6. The backpack as defined in claim 5 and wherein a lower portion of a main compartment of the pack may be compressed by adjustment of a pair of horizontal compression straps, by means of a quick-release buckle on each strap.

7. The backpack as defined in claim 5 and wherein a bottom portion of a main compartment of the pack may be compressed by adjustment of a pair of vertical compression straps by means of a quick-release buckle on each vertical compression strap.

8. The backpack as defined in claim 1 and wherein the back pad is generally T-shaped, constructed of a breathable foam material and fastened to the upper portion of the back wall and at a middle portion of the back wall thereby forming the transverse shoulder harness slot between pad and back wall.

9. The backpack as defined in claim 8 and wherein the shoulder harness pivotally attaches to a vertical harness strap and the adjustable pivot buckle affixed to an upper portion of the back wall and the middle portion of the back wall.

10. The backpack as defined in claim 9 an wherein the pack may be adjusted up or down on the person's back by vertical adjustment of the pivot buckle on the vertical harness strap within the shoulder harness slot.

11. The backpack as defined in claim 9 and wherein the shoulder harness further comprises:

a pair of shoulder pads forming a "V" at the pivotal attachment point in the transverse slot;

a pair of adjustable shoulder straps having a first end affixed to a front portion of the shoulder harness and a second end affixed to a triangular V-shaped joint on a back portion of the harness;

a detaching quick-release buckle affixed to the harness strap triangular V-shaped joint;

a horizontal and vertically adjustable shoulder blade strap affixed between the shoulder straps;

a pair of shoulder strap mesh pieces diagonally affixed to a front portion of the shoulder straps;

a pair of adjustable mesh piece straps affixing the shoulder straps to the body; and a horizontal and vertically adjustable sternum strap affixed to the shoulder strap front portion between the shoulder straps.

12. The backpack as defined in claim 11 and wherein the shoulder pads are constructed of layers of material comprising:

an inside outer nylon mesh cover;

a hydrophobic plastic foam adjacent the inside cover;

a closed cell plastic foam adjacent the hydrophobic plastic foam having ventilation by a plurality of apertures in the foam; and an outer nylon mesh cover adjacent the closed cell plastic foam;

wherein the outside nylon cover is longer than the inside cover such that when sewn together the shoulder pads maintain a curved configuration.

13. The backpack as defined in claim 11 and wherein the shoulder blade strap further comprises a pair of adjustable strap loops affixed to the shoulder straps at a first end and to an adjustable quick-release buckle at a second end, such that the lengths of the strap loops are adjustable.

14. The backpack as defined in claim 11 and wherein the sternum strap further comprises a pair of horizontal sternum strap loops affixed to the shoulder straps at a first end and to an adjustable quick-release sternum buckle at a second end, such that the lengths of the loops are adjustable.

15. The backpack as defined in claim 8 and wherein the lumbar pad is constructed of a breathable foam material and is affixed to the body at the middle portion of the back wall and at the lower portion of the back wall thereby forming the belt slot.

16. The backpack as defined in claim 15 and wherein the belt is inserted within the belt slot and affixed to the body by a hook-and-pile fastener and a pair of bi-directional compression straps affixed on the body.

17. The backpack as defined in claim 16 and wherein the belt is constructed of layers of material comprising:

an inside nylon mesh cover;

a hydrophobic plastic foam adjacent the inside cover;

a closed cell plastic foam adjacent the hydrophobic plastic foam having ventilation by a plurality of apertures in the foam; and an outer nylon mesh cover adjacent the closed cell plastic foam.

18. The backpack as defined in claim 16 and wherein the bi-directional compression straps further comprise:

a pair of belt straps having a first end affixed to a lower front portion of the body;

a pair of belt loops affixed to the belt; and a second end of said belt straps adjustably affixed to the middle body portion.

19. A universally adjustable backpack comprising:

a wedge-shaped pack body having front, back, and side walls defining a plurality of compartments;

an inverted T-shaped back pad affixed substantially transversely across an upper portion of the back wall to form a substantially transverse shoulder harness slot between the back wall and the back pad;

an adjustable shoulder harness pivotally affixed within the slot such that the shoulder harness may pivot with respect to the body;

an hourglass-shaped lumbar pad affixed substantially transversely across a lower portion of the back wall to form a substantially transverse belt slot between the body and lumbar pad; and a detachable belt inserted within the belt slot between the lumbar pad and the lower back wall portion, such that the weight of the backpack is supported by a lumbar region of a person's body and the shoulder harness and lumbar pad may pivot with respect to the pack body.

20. The backpack as defined in claim 19 and wherein the plurality of compartments further comprises:

a main compartment zippered at a top portion of the body;

a pair of insulated and zippered bottle holsters affixed on the side walls of the body; and a triangular zipper pocket affixed at a center portion of the body.

21. The backpack as defined in claim 20 and wherein a gussetted zipper pocket is affixed at the lower back wall portion of the body.

22. The backpack as defined in claim 20 and wherein the bottle holsters have a diagonal zipper and an inside book-and-pile fastener such that an open holster cover may be hooked to allow access to a water bottle within the holster.

23. The backpack as defined in claim 19 and wherein the body is gussetted at a lower side portion of the body and at a bottom portion of the body.

24. The backpack as defined in claim 19 and wherein the T-shaped back pad is constructed of a breathable foam material and fastened to the upper portion of the back wall and at a middle portion of the back wall thereby forming the transverse shoulder harness slot between pad and back wall.

25. The backpack as defined in claim 24 and wherein the shoulder harness pivotally attaches to a vertical harness strap and the adjustable pivot buckle affixed to an upper portion of the back wall and the middle portion of the back wall.

26. The backpack as defined in claim 25 and wherein the shoulder harness further comprises:

a pair of shoulder pads forming a "V" at the pivotal attachment point in the transverse slot;

a pair of adjustable shoulder straps having a first end affixed to a front portion of the shoulder harness and a second end affixed to a triangular V-shaped joint on a back portion of the harness;

a detaching quick-release buckle affixed to the harness strap V-shaped joint;

a horizontal and adjustable shoulder blade strap affixed between the shoulder straps;

a pair of shoulder strap mesh pieces diagonally affixed to the front portion of the shoulder straps;

a pair of adjustable mesh piece straps affixing the shoulder straps to the body; and an adjustable sternum strap affixed to the shoulder strap front portion between the shoulder straps.

27. The backpack as defined in claim 26 and wherein the shoulder pads are constructed of layers of material comprising:

an inside nylon mesh cover;

a hydrophobic plastic foam adjacent the inside cover;

a closed cell plastic foam adjacent the hydrophobic plastic foam, having ventilation by a plurality of apertures in the foam; and an outer nylon mesh cover adjacent the closed cell plastic foam;

wherein the outside nylon cover is longer than the inside cover such that when sewn together the shoulder pads maintain a curved configuration.

28. The backpack as defined in claim 24 and wherein the lumbar pad is constructed of a breathable foam material and is affixed to the body at the middle portion of the back wall and at the lower portion of the back wall thereby forming the belt slot.

29. The backpack as defined in claim 28 and wherein the belt is inserted within the belt slot and affixed to the body by a hook-and-pile fastener and a pair of bi-directional compression straps affixed on the body.

30. The backpack as defined in claim 29 and wherein the belt is constructed of layers of material comprising:

an inside nylon mesh cover;

a hydrophobic plastic foam adjacent the inside cover;

a closed cell plastic foam adjacent the outside cover having ventilation by a plurality of apertures in the foam; and an outer nylon mesh cover adjacent the closed cell plastic foam.

31. A universally adjustable backpack comprising:

a cloth body having a main zippered compartment with front, side, and back walls, the back wall having a triangular zipper pocket affixed thereto and a gussetted pocket affixed at a lower back wall portion and having a pair of insulated bottle holster pockets affixed at the side wall of the body;

an inverted T-shaped back pad affixed substantially transversely across an upper portion of the back wall forming a substantially transverse shoulder harness slot;

an adjustable shoulder harness pivotally affixed to the back wall upper portion behind the back pad within the shoulder harness slot and having a permanently contoured shoulder pad;

a lumbar pad affixed substantially transversely across the lower back wall portion forming a substantially transverse belt slot; and a belt affixed within the belt slot whereby the weight of the backpack is supported by a lumbar region of a person's body.

* * * * *